US005441604A

United States Patent [19]

Sandberg et al.

[11] Patent Number: 5,441,604

[45] Date of Patent: Aug. 15, 1995

[54] EXTENDED NIP PRESS APPARATUS

[75] Inventors: Brian G. Sandberg, Janesville, Wis.; David A. Brandt, Rockton, Ill.; Dale A. Brown, Milton, Wis.; Robert E. Collins, Rockton, Ill.; David V. Lange, Beloit, Wis.; Bruce L. Lindstrand, Roscoe; Michael A. Radtke, South Beloit, both of Ill.

[73] Assignee: Beloit Technologies, Inc., Wilmington, Del.

[21] Appl. No.: 198,803

[22] Filed: Feb. 17, 1994

[51] Int. Cl.[6] ..... D21F 3/02

[52] U.S. Cl. ..... 162/205; 162/358.3; 162/361

[58] Field of Search ..... 162/205, 358.3–358.5, 162/361, 199, 272; 100/154

[56] References Cited

U.S. PATENT DOCUMENTS

| | | | |
|---|---|---|---|
| 4,287,021 | 9/1981 | Justus et al. | 162/358.3 |
| 4,568,423 | 2/1986 | Laapotti | 162/358.3 |
| 4,917,767 | 4/1990 | Ilmarinen et al. | 162/358.3 |
| 5,110,417 | 5/1992 | Lehtonen et al. | 162/358.3 |
| 5,167,768 | 12/1992 | Cronin et al. | 162/358.3 |
| 5,262,011 | 11/1993 | Ilmarinen | 162/358.1 |

*Primary Examiner*—Karen M. Hastings

*Attorney, Agent, or Firm*—Dirk J. Veneman; Raymond W. Campbell; David J. Archer

[57] ABSTRACT

An extended nip press apparatus is disclosed for removing water from a web. The apparatus includes a rotatable backing roll and an elongate shoe which cooperate with the backing roll for defining therebetween an extended nip for the passage therethrough of the web. The shoe defines a concave surface. A bearing blanket is movably disposed between the backing roll and the concave surface. The arrangement is such that the web is supported by the blanket with the web being disposed between the blanket and the backing roll. A lubricant is supplied between the concave surface and the blanket such that the blanket is slidingly supported by the concave surface during passage of the blanket through the extended nip. The concave surface encompasses a pocket defined by the shoe. The arrangement is such that the pocket is filled with lubricant flowing from the concave surface so that in the event of a wad of the web entering into the extended nip, the wad is yieldingly received within the pocket so that damage to the blanket by the wad is minimized.

13 Claims, 5 Drawing Sheets

EXTENDED NIP PRESS APPARATUS

BACKGROUND OF THE INVENTION

1. Field of the Invention

The present invention relates to an extended nip press apparatus for removing water from a web. More particularly, the present invention relates to a press apparatus having an elongate shoe defining a concave surface having a pocket therein.

2. Information Disclosure Statement

Extended nip presses enable the residence time of the web within a press nip to be increased so that more water is able to be removed from the web.

Basically, extended nip presses fall into two categories as follows: 1) Hydrodynamic; 2) Hydrostatic. First, a hydrodynamic press includes a hydrodynamic shoe. The shoe defines a concave surface which cooperates with a rotatable backing roll such that a bearing blanket is able to slidingly engage the concave surface for supporting the web during passage through an extended nip. Lubricant is supplied between the bearing blanket and the concave surface in order to permit the blanket to slide along the concave surface.

Second, several hydrostatic presses have been proposed in which the aforementioned concave surface of the shoe defines a pocket so that at least for a portion of the travel of the blanket through the extended nip, the blanket is hydrostatically supported by a lubricant within the pocket.

More recently, as exemplified in U.S. Pat. No. 5,262,011 to Ilmarinen, wedge-shaped pockets have been proposed in which the trailing end of the pocket decreases to a zero depth. One of the objectives of the wedge- shaped pocket is to inhibit damage of the blanket in the event of a wad of the web entering the extended nip. Such wad would tend to be received within the hydrostatic pocket. However, if the hydrostatic pocket abruptly terminates at the trailing end thereof, there is a tendency for the wad to cause a sudden pressure surge as the wad tends to move between the blanket and the concave surface at the trailing end of the pocket.

The aforementioned U.S. Pat. No. 5,262,011 is provided with channel means for supplying pressurized lubricant to the hydrostatic pocket. Applicant has discovered that the aforementioned pocket has a comparable performance, even when lubricant is not supplied to the pocket by independent lubricant supply means. Therefore, the provision of costly ancillary equipment, such as pumps, control valves and piping, is avoided.

Moreover, Applicant has discovered that sufficient lubricant flows from the concave surface disposed upstream relative to the pocket into the pocket in order to provide support for the bearing blanket moving through the extended nip.

Therefore, it is a primary objective of the present invention to provide an extended nip press apparatus having an elongate shoe with a concave surface that encompasses a pocket. The arrangement is such that the pocket is filled with lubricant flowing from the concave surface so that in the event of a wad of the web entering into the extended nip, the wad is yieldingly received within the pocket so that damage to the blanket by the wad is minimized.

Other objects and advantages of the present invention will be readily apparent to those skilled in the art by a consideration of the detailed description contained hereinafter, taken in conjunction with the annexed drawings.

SUMMARY OF THE INVENTION

The present invention relates to an extended nip press apparatus and method for removing water from a web. The apparatus includes a rotatable backing roll and an elongate shoe which cooperates with the backing roll for defining therebetween an extended nip for the passage therethrough of the web. The shoe defines a concave surface. A bearing blanket is movably disposed between the backing roll and the concave surface. The arrangement is such that the web is supported by the blanket, with the web being disposed between the blanket and the backing roll.

Lubricant supply means is provided for supplying lubricant between the concave surface and the blanket such that the blanket is slidingly supported by the concave surface during passage of the blanket through the extended nip.

The concave surface encompasses a pocket which is defined by the shoe. The arrangement is such that the pocket is filled with lubricant flowing from the concave surface so that in the event of a wad of the web entering into the extended nip, the wad is yieldingly received within the pocket so that damage to the blanket by the wad is minimized.

DETAILED DESCRIPTION OF THE DRAWINGS

Figure 1:
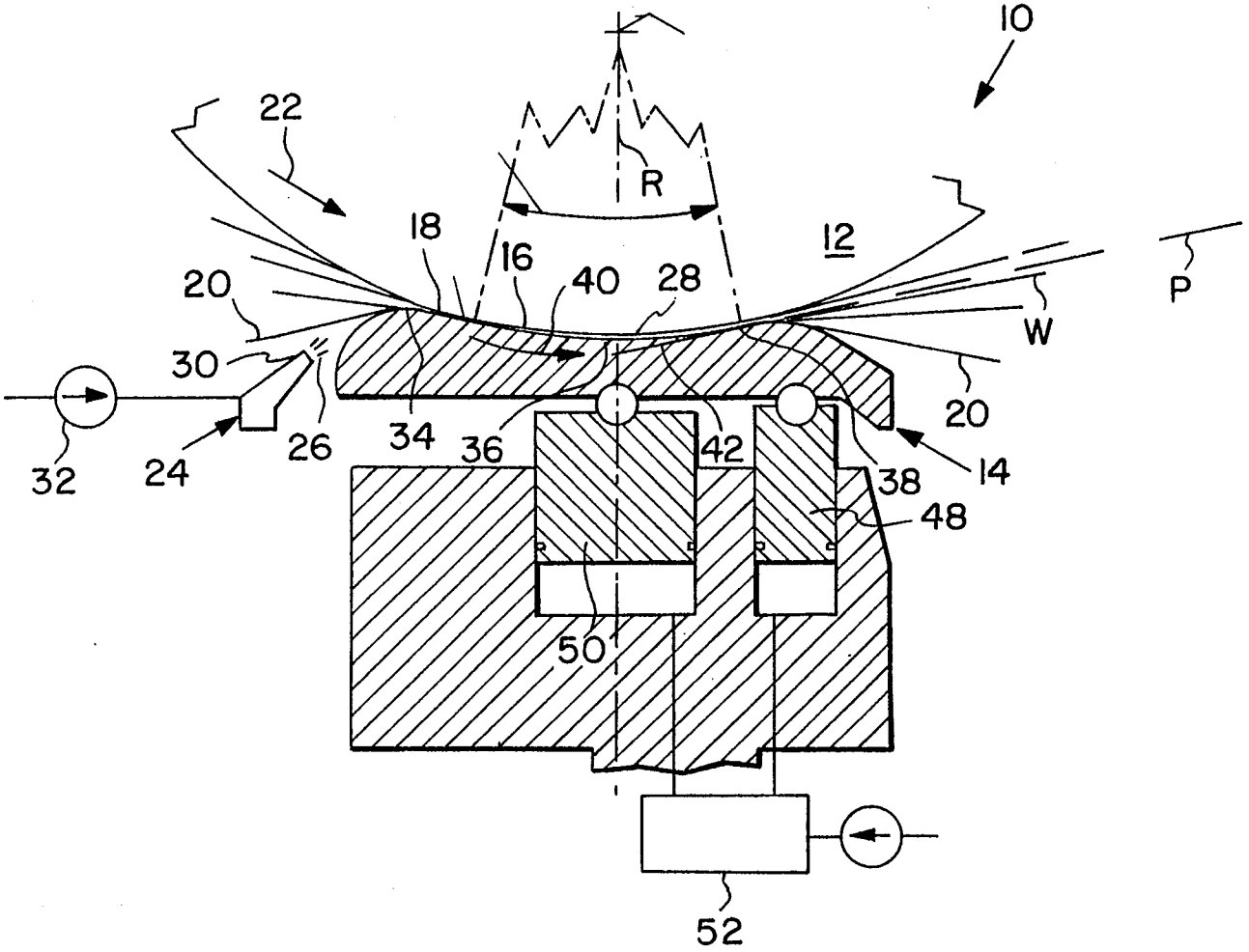
FIG. 1 is a side-elevational view of an extended nip press apparatus according to the present invention.

FIG. 1 is a side-elevational view of an extended nip press apparatus, generally designated 10, for removing water from a web W. The apparatus 10 includes a rotatable backing roll 12 and an elongate shoe, generally designated 14, which cooperates with the backing roll 12 for defining therebetween an extended nip 16 for the passage therethrough of the web W. The shoe 14 defines a concave surface 18.

A bearing blanket 20 is movably disposed, as indicated by the arrow 22, between the backing roll 12 and the concave surface 18. The arrangement is such that the web W is supported by the blanket 20. The web W is disposed between the blanket 20 and the backing roll 12.

Means, generally designated 24, is provided for supplying lubricant 26 between the concave surface 18 and the blanket 20 such that the blanket 20 is slidingly supported by the concave surface 18 during passage of the blanket 20 through the extended nip 16.

The concave surface 18 encompasses or surrounds a pocket 28 defined by the shoe 14. The arrangement is such that the pocket 28 is filled with only lubricant 26 flowing from the concave surface 18 so that in the event of a wad of the web entering into the extended nip 16, the wad is yieldingly received within the pocket 28 so that damage to the blanket 20 by the wad is minimized. The blanket 20 and concave surface 18 cooperate together to seal the pocket 28.

The concave surface 18 has a machine directional length within the range 8 to 12 inches. In a preferred embodiment of the present invention, the length is 10 inches.

The concave surface 18 has a radius of curvature R which is substantially equivalent to a radius of curvature of the backing roll 12.

The bearing blanket 20 is fabricated from a woven or non-woven base impregnated with polyurethane.

The means 24 for supplying lubricant 26 is disposed upstream relative to the shoe 14. The means 24 includes a plurality of nozzles 30 connected to a pressurized supply of lubricant 32 such that the lubricant 26 is applied to an upstream end 34 of the shoe 14 between the concave surface 18 and the blanket 20.

The pocket 28 extends in a cross-machine direction such that the pocket 28 has a width which is almost equal to the width of the bearing blanket 20.

The pocket 28 has a depth which decreases from an upstream end 36 of the pocket 28 to a downstream end 38 of the pocket.

In a preferred embodiment of the present invention, the depth decreases to zero adjacent to the downstream end 38 of the pocket 28.

The concave surface 18 provides hydrodynamic support for the bearing blanket 20 with lubricant 26 flowing from the hydrodynamic support upstream relative to the pocket 28 into the pocket 28, as indicated by the arrow 40.

The pocket 28 includes a bottom surface 42 which is disposed in a flat plane P.

Figure 6:
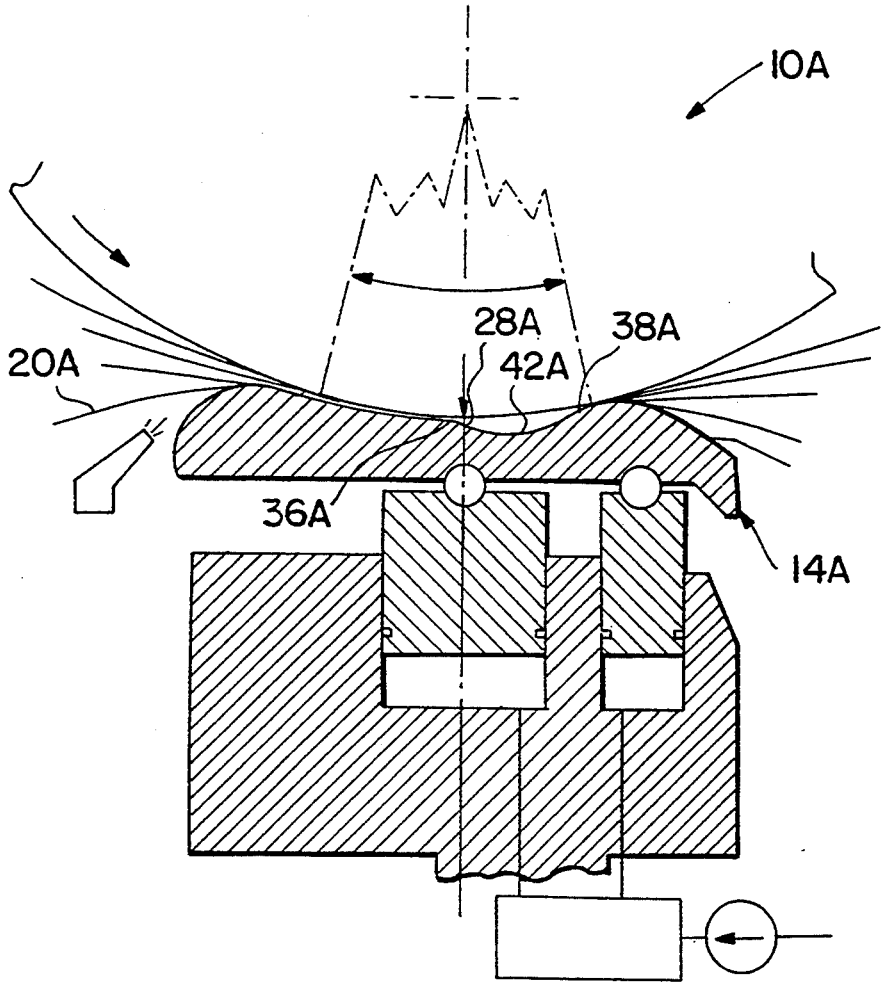
FIG. 6 is a similar view to that shown in FIG. 1, but shows an alternative embodiment of the present invention in which the bottom surface of the pocket is curved.

In an alternative embodiment of the present invention, as shown in FIG. 6, the pocket 28A includes a bottom surface 42A which is curved in a direction from the upstream end 36A to a downstream end 38A of the pocket 28A.

Figure 7:
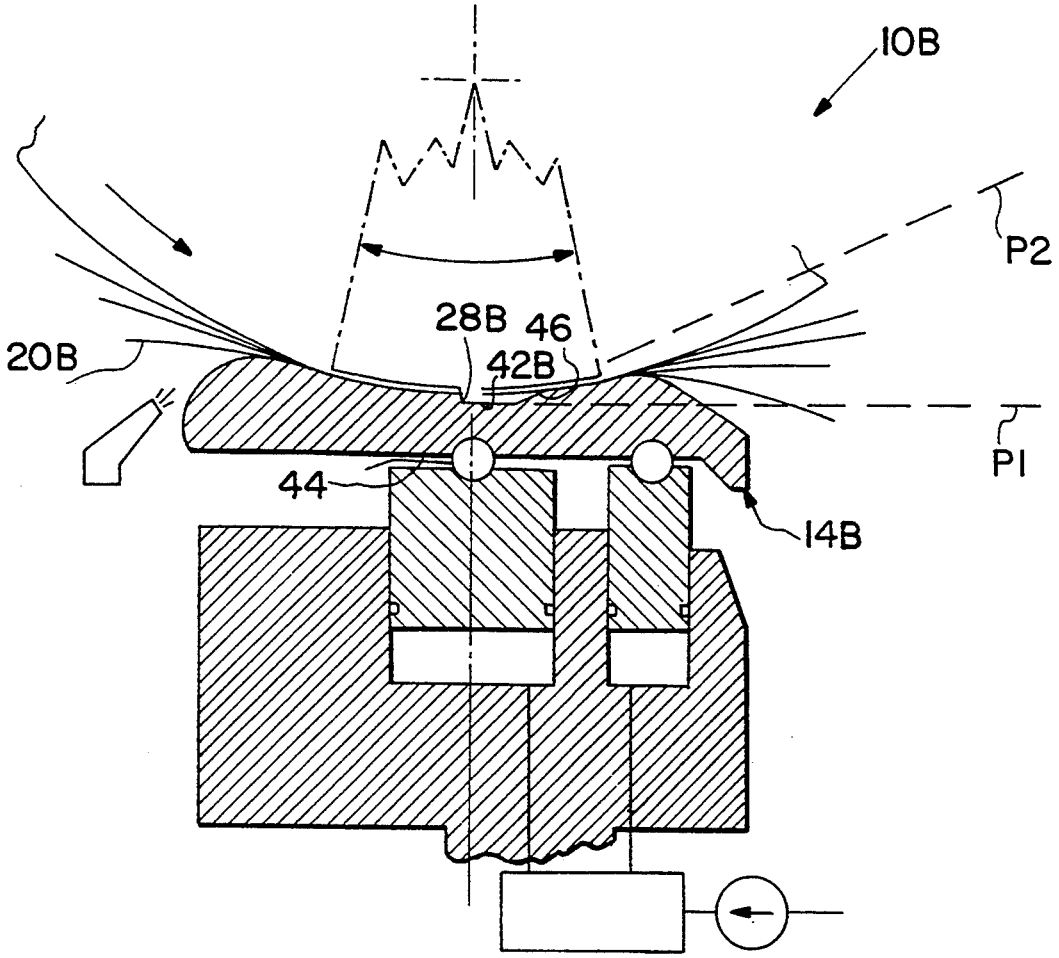
FIG. 7 is a similar view to that shown in FIG. 1, but shows a further embodiment of the present invention in which the bottom surface of the pocket includes a first and second portion.

In another embodiment of the present invention, as shown in FIG. 7, the pocket 28B includes a bottom surface 42B having a first portion 44 which is disposed in a first flat plane P1 and a second portion 46, which is disposed in a second flat plane P2. The first portion 44 is disposed upstream relative to the second portion 46.

In a preferred embodiment of the present invention, the press apparatus 10 further includes support means 48 which cooperate with the elongate shoe 14 for urging the shoe 14 towards the backing roll 12.

Additionally, the apparatus 10 includes a further support means 50 disposed upstream relative to the support means 48. The further support means 50 cooperates with the elongate shoe 14 for urging the shoe 14 towards the backing roll 12.

Control means 52 are connected to the support and further support means 48 and 50, respectively, for controlling the support 48 and further support means 50. The arrangement is such that the application of differential pressure in a machine direction is permitted.

Test results have indicated that a pocket shoe without a direct supply of oil or lubricant provides comparable load pressure relief to a hydrostatic shoe where oil is supplied to the pocket shoe.

More particularly, it has been discovered that the majority of the wad relief provided by a pocketed or hydrostatic shoe is due to the pocket itself and its associated depth, and not to the flow of lubricant through the pocket.

Figure 2:
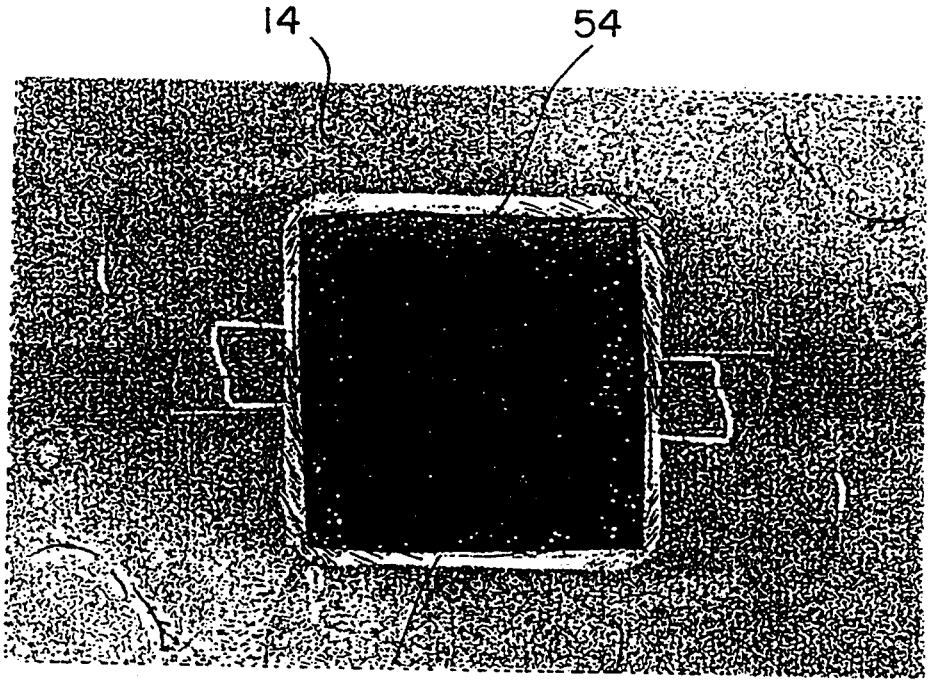
FIG. 2 is a top view of a static nip impression demonstrating the effect of a wad of the web disposed within an extended nip of a hydrodynamic press shoe.

The following illustrates the results of the aforementioned tests:

FIG. 2 shows a static nip impression of a solid 10-inch shoe at 6,000 pounds per linear inch (pli) with a 4 inch by 4 inch by 0.045 inch thick LEXAN sheet, which simulates a wad of the web. As the impression shows, the majority of the load is taken by the wad as seen by the dark square 54. The remainder of the shoe 14, as shown by the surrounding lighter areas, does not take very much of the load pressure.

Figure 3:
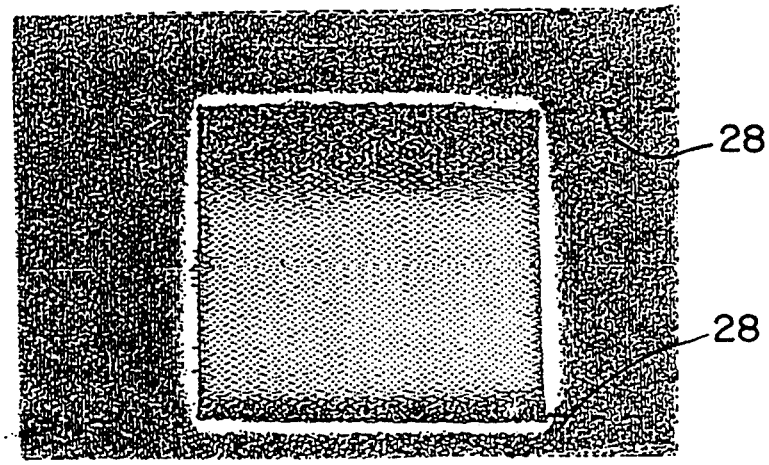
FIG. 3 is a similar view to that shown in FIG. 2, but shows a shoe with a pocket according to the present invention with no connection to a pressurized source of lubricant.

FIG. 3 is a similar view to that shown in FIG. 2 and illustrates a static nip impression of a no-flow, 4-inch machine directional pocketed shoe at 6,000 pli with a simulated wad located at the pocket 28. The dotted lines 28 indicate the pocket location. The pocket 28 was supplied with appropriate lubricant flow to simulate a pocket with no flow of lubricant at running speed. Such flow was determined by the pocket pressure achieved by a no-flow pocket at running conditions. The impression shows that the load pressure is much more evenly distributed across the shoe with a pocket shoe as compared to a hydrodynamic shoe.

Figure 4:
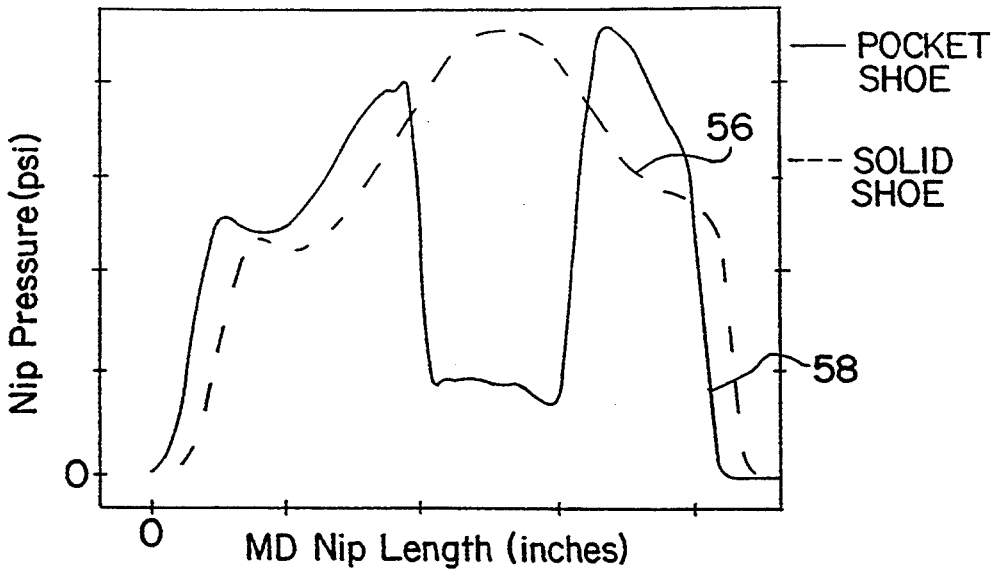
FIG. 4 is a graph showing, on the one hand, a pressure profile for a solid shoe, that is a hydrodynamic shoe, and on the other hand, the pressure profile for a shoe having a pocket defined therein.

FIG. 4 is a graph comparing a dynamic pressure profile for (1) a solid, that is a hydrodynamic shoe, as indicated by the pressure profile 56, (2) a 4-inch pocketed shoe with no flow, as indicated by the pressure profile 58.

Figure 5:
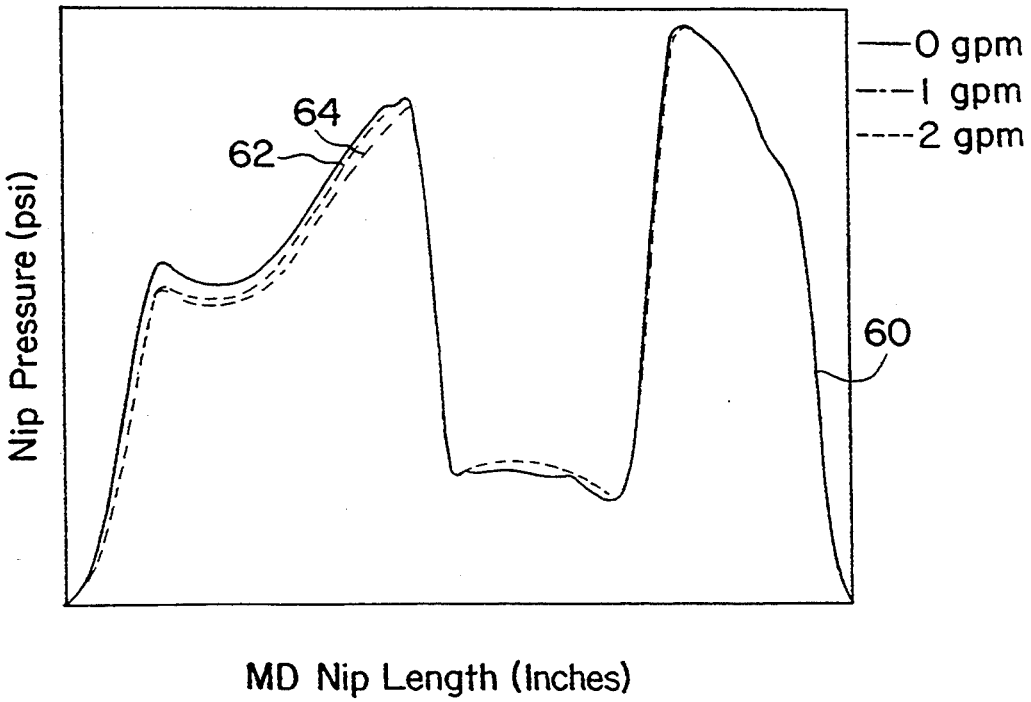
FIG. 5 is a graph which compares the pressure profiles for a pocket shoe having a lubricant flow of zero, one gallon per minute and two gallons per minute, respectively.

FIG. 5 shows pressure profiles for (1) a 4-inch pocketed shoe with no flow, as indicated by the pressure profile 60, (2) a 4-inch pocketed shoe with one gallon per minute flow to the pocket, as indicated by the pressure profile 62, (3) a 4-inch pocketed shoe with a two gallons per minute flow to the pocket, as indicated by the pressure profile 64.

The area under each curve 60,62 and 64 is referred to as the pressure impulse for that particular arrangement. According to the curve, the press impulse comparison for the various arrangements is as follows:

| | Arrangement | Pocket Flow | Impulse % | Impulse % Diff. From Standard |
|---|---|---|---|---|
| 1. | Solid | — | 100% | 0. |
| 2. | 4" MD Pocket | 0. | 78% | 22% |
| 3. | 4" MD Pocket | 1 GPM | 76% | 24% |
| 4. | 4" MD Pocket | 2 GPM | 74% | 26% |

According to the aforementioned data, the total load that the wad undergoes in the 4-inch pocket arrangement with no flow of lubricant is 22% less than the same wad load in the solid shoe. However, adding a flow of lubricant of one gallon per minute to the pocket decreases the wad impulse by only an additional 2%.

Accordingly, it has been determined that the pocket itself provides the majority of the wad load relief.

The present invention also includes a method of pressing water from a web in an extended nip press, the method including the steps of applying lubricant to an upstream end of an elongate shoe between the shoe and a bearing blanket such that the lubricant flows into a pocket encompassed by a concave surface of the shoe, the concave surface cooperating with a backing roll for defining therebetween an extended nip, the arrangement being such that in the event of a wad of the web entering the extended nip, the wad is yieldingly received within the pocket so that damage to the blanket by the wad is minimized.

The present invention provides a means for greatly reducing the requirements for ancillary equipment for supplying lubricant by means of channels, pumps and the required conduits for a shoe press.

What is claimed is:

1. An extended nip press apparatus for removing water from a web, said apparatus comprising:

a rotatable backing roll;

a hydrodynamic shoe cooperating with said backing roll for defining therebetween an extended nip for the passage therethrough of the web, said shoe defining a concave surface;

a bearing blanket movably disposed between said backing roll and said concave surface, the arrangement being such that the web is supported by said blanket, the web being disposed between said blanket and said backing roll;

means disposed upstream relative to said concave surface for supplying lubricant between said concave surface and said blanket such that said blanket is slidingly supported by said concave surface during passage of said blanket through said extended nip; and said concave surface encompassing a pocket defined by said shoe, the arrangement being such that said pocket is sealed by said surface and blanket and filled only with said lubricant flowing from said concave surface so that in the event of a wad of the web entering into said extended nip, said wad is yieldingly received within said pocket so that damage to said blanket by said wad is minimized.

2. An extended nip press apparatus as set forth in claim 1, wherein said concave surface has a machine directional length within the range 8 to 12 inches.

3. An extended nip press apparatus as set forth in claim 1, wherein said concave surface has a radius of curvature substantially equivalent to a radius of curvature of said backing roll.

4. An extended nip press apparatus as set forth in claim 1, wherein said bearing blanket is fabricated from urethane.

5. An extended nip press apparatus as set forth in claim 1, wherein said means for supplying lubricant is disposed upstream relative to said shoe, said means including:

a plurality of nozzles connected to a pressurized supply of lubricant such that said lubricant is applied to an upstream end of said shoe between said concave surface and said blanket.

6. An extended nip press apparatus as set forth in claim 1, wherein said pocket extends in a cross-machine direction such that said pocket has a width which is almost equal to the width of said bearing blanket.

7. An extended nip press apparatus as set forth in claim 1, wherein said pocket has a depth which decreases from an upstream end to a downstream end thereof.

8. An extended nip press apparatus as set forth in claim 7, wherein said depth decreases to zero adjacent to said downstream end of said pocket.

9. An extended nip press apparatus as set forth in claim 1, wherein said pocket includes:

a bottom surface which is disposed in a flat plane.

10. An extended nip press apparatus as set forth in claim 1, wherein said pocket includes:

a bottom surface which is curved in a direction from an upstream to a downstream end thereof.

11. An extended nip press apparatus as set forth in claim 1, wherein said pocket includes:

a bottom surface having a first portion which is disposed in a first flat plane and a second portion which is disposed in a second flat plane, said first portion being disposed upstream relative to said second portion.

12. An extended nip press apparatus as set forth in claim 1, further including:

support means cooperating with said elongate shoe for urging said shoe towards said backing roll;

a further support means disposed upstream relative to said support means, said further support means cooperating with said elongate shoe for urging said shoe towards said backing roll;

control means connected to said support and further support means for controlling said support and further support means, the arrangement being such that the application of differential pressure in a machine direction is permitted.

13. A method of pressing water from a web in an extended nip press, said method including the steps of:

applying lubricant from a lubricant supply disposed upstream relative to a concave surface defined by a hydrodynamic shoe, the lubricant being supplied to an upstream end of the shoe between the shoe and a bearing blanket such that only the lubricant flows into a pocket encompassed by the concave surface of the shoe, the blanket and concave surface cooperating together to seal the pocket;

the concave surface cooperating with a backing roll for defining therebetween an extended nip, the arrangement being such that in the event of a wad of the web entering the extended nip, the wad is yieldingly received within the pocket so that damage to the blanket by the wad is minimized.

* * * * *